United States Patent [19]

Overman et al.

[11] 4,284,862

[45] Aug. 18, 1981

[54] ACCELERATION SWITCH

[75] Inventors: David L. Overman; Robert N. Johnson, both of Silver Spring, Md.

[73] Assignee: The United States of America as represented by the Secretary of the Army, Washington, D.C.

[21] Appl. No.: 132,205

[22] Filed: Mar. 20, 1980

[51] Int. Cl.[3] ..... H01H 35/02, F42C 15/40

[52] U.S. Cl. ..... 200/61.45 R; 102/262; 200/61.5; 200/276

[58] Field of Search ..... 102/262, 264, 200/61.45-61.53;276

[56] References Cited

U.S. PATENT DOCUMENTS

| | | | |
|---|---|---|---|
| 2,424,390 | 7/1947 | Ferris | 200/61.53 |
| 2,854,539 | 9/1958 | Ruppel | 200/61.45 |
| 3,126,758 | 3/1964 | Martin et al. | 74/565 |
| 3,548,137 | 12/1970 | Farrell et al. | 200/61.04 X |
| 3,798,399 | 3/1974 | Corporandy | 200/61.5 X |

OTHER PUBLICATIONS

Harry Diamond Laboratories; Louis Richmond et al.; "Hi-Performance PD Fuze for Mortar and Artillery"; Dec. 1971, Publication No. HDL-TR-1577.

Harry Diamond Laboratories; D. L. Overman et al.; "Proposed New Setback Sensor for XM734 Mortar Fuze"; Nov. 19, 1973; Report No. M-420-73-3.

Harry Diamond Laboratories; L. Ronyus et al.; "Zig--Zag Setback Sensor—Low Cost Cam Design", Nov. 21, 1973; Report No. M-420-73-4.

Harry Diamond Laboratories; A. Greg Beard; "The Zig-Zag Setback Sensor"; Jan. 30, 1974; Report No. R-420-74-1.

*Primary Examiner*—James R. Scott

*Attorney, Agent, or Firm*—Nathan Edelberg; Robert P. Gibson; Saul Elbaum

[57] ABSTRACT

An acceleration actuated switch is disclosed which is capable of distinguishing between random and brief acceleration forces on the one hand and sustained acceleration forces on the other hand. The device comprises a stationary electrical contact and a movable contact held in position by biasing means. Sustained acceleration forces in a particular direction will drive the movable contact along a fixed path to a position whereat the biasing means may bring the movable contact into proximity with the stationary contact thereby closing the switch. If the acceleration force is not in the proper direction or is not applied to the switch for a sufficient length of time, the biasing means will return the movable contact to its original position thereby maintaining the switch in an open condition.

9 Claims, 5 Drawing Figures

ACCELERATION SWITCH

RIGHTS OF THE GOVERNMENT

The invention described herein may be manufactured, used and licensed by or for the U.S. Government for governmental purposes without the payment to us of any royalty thereon.

BACKGROUND OF THE INVENTION

Mortar shells, artillery shells and other such explosive projectiles normally comprise a safing and arming circuit which operates to allow detonation of the explosive only after the projectile has been fired or launched. Often, the safing and arming circuit will comprise a switching device which responds to a "signature" or force due to firing, such as the setback acceleration or the spin of the projectile. It is essential that such a switching device responds only upon firing of the projectile and not react to impacts due to mishandling of the explosive shell. Switches known in the prior art which meet this need are generally complex gas or liquid damped designs which are very costly and require precision assembly of parts.

It is therefore an object of this invention to provide an acceleration actuated switch which is simple, inexpensive and easy to assemble.

It is a further object of this invention to provide an acceleration actuated switch which is capable of operation as a time-delay switch.

It is an object of this invention to provide such a switch which is suitable for use as a safety switch in projectiles and explosive devices. It is a further object of the invention to provide a safety switch which will not actuate or close under any type of handling, mishandling or transportation forces.

It is an object of the invention to provide a safety switch which is especially suited to be actuated upon firing from a weapon.

DESCRIPTION OF A PREFERRED EMBODIMENT

Figure 1:
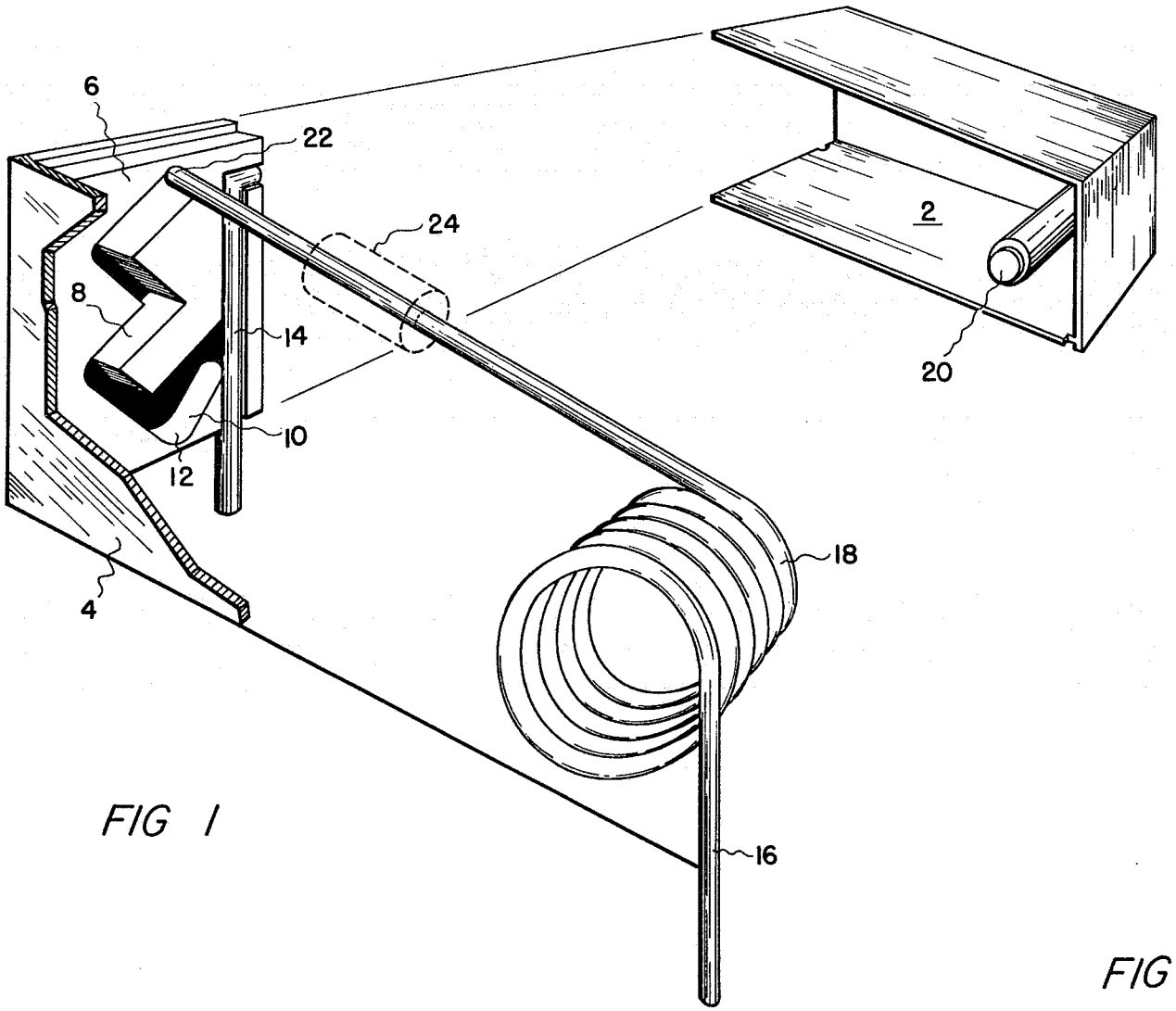
FIG. 1 is an exploded view of a first embodiment of the present invention.

FIG. 1 shows a first embodiment of the switch of the present invention which comprises a casing 2, 4 comprised of non-conductive material such as molded plastic. First contact 16 comprises a flexible wire element formed into a coil 18 and having a cantilevered end 22. Second contact 14 comprises a stationary wire element secured in end face 6. The cantilevered end 22 of the first contact engages in a track or guide means 8 formed in the end face 6 of the switch housing and is biased into a first position at the top of guide 8, as shown in FIG. 1.

Under sustained acceleration force acting so as to drive the cantilevered end 22 downward toward the base 12 of the guide means 8, the cantilevered end will traverse the guide means 8 and will be held by the acceleration force in the lower-most, or second position 12. When the acceleration force ceases, the cantilevered end of the contact 16 will be biased upwardly by the coil spring portion 18, and traverse guide portion 10, coming into contact with wire element 14 at a third position in the guide thereby closing the switch.

Figure 2:
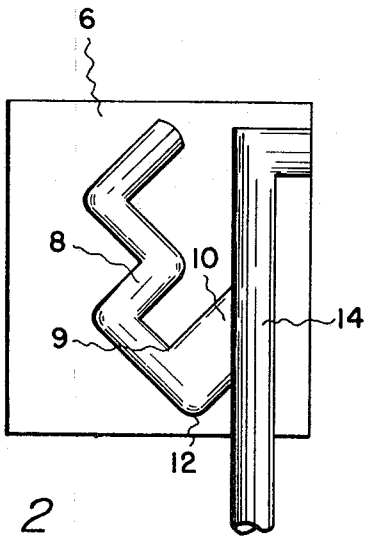
FIG. 2 is a detailed showing of the guide means for the movable contact of the present switching device.

FIG. 2 shows in greater detail the configuration of the guide means, or track 8. It can be seen that the lower-most portion or position 12 is offset toward the contact 14 with respect to point 9 of the guide means. This will assure that once the cantilevered end 22 is driven to position 12, the biasing force of the spring element 18 will cause the cantilevered contact to traverse portion 10 of the guide means, and come in contact with wire 14. The offset of position 12 with respect to point 9 prevents the cantilevered contact element 22 from being driven back along portion 8 of the guide means. Also, the configuration of the guide means will assure that the contact portion 22 will remain wedged against the wire 14, once the switch is closed.

If the acceleration force is not sustained long enough for the tip 22 of contact 16 to traverse the zig-zag portion 8 of the guide means, the end of the contact will be reset to the safe or open position at the top of the guide means as a result of the return bias of the spring 18. The safety, or resistance to actuation, provided by this switch is dependent on the bias force provided by the coil 18 of the contact spring and by the constraint imposed by the deviated path of the guide means. The deviated or zig-zag path forces the end of the contact to start and stop each time the path changes direction. The movable contact therefore must start and stop several times before it can reach the base 12 of the path, and therefore the second contact 14. This start and stop action requires the driving acceleration force to be sustained over a prolonged period and it is the principle feature which ensures that the switch will not be actuated by randomly imposed brief acceleration forces. The switch is therefore highly resistant to accidental closure resulting from dropping, mishandling, etc. and will only be actuated upon sustained acceleration such as occurs when the device is launched from a weapon.

The acceleration force necessary for actuation of the switch device can be adjusted by varying the effective spring force of the spring portion of the contact. This may be accomplished by varying the material from which the contact is composed, the diameter of the wire comprising the contact, the number or diameter of the coils 18, or the length of the cantilevered portion 22. The necessary force can be further adjusted by adding auxiliary weights to the cantilevered portion 22, as shown in phantom lines at 24. This may be accomplished, for example, by crimping a small piece of metal tubing to the cantilevered portion of the contact.

The casing of the switch device may also comprise a support means 20, adapted to stabilize the position of coils 18 of the switch.

The switch parts could be advantageously made of clear plastic so that the open or closed condition of the switch could be readily observed. This would be especially valuable in a testing situation whereby one could easily observe the functioning of the device. The switching device of the present invention may also be reset after testing by placing it on a centrifuge in an orientation such that the cantilevered portion of the contact will be driven back down guide portion 10 and allowed to then traverse guide portion 8.

Figure 3:
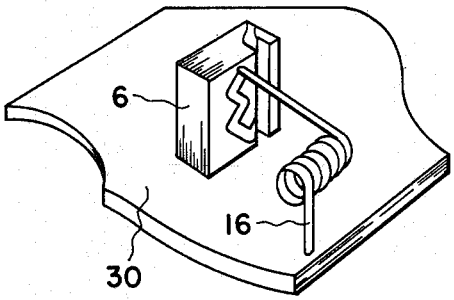
FIG. 3 shows an alternate embodiment of the invention, adapted to be installed, for example, on an open circuit board.

FIG. 3 illustrates a second embodiment of the invention which is functionally similar to that of FIG. 1 but does not comprise a housing or casing for the switch elements. In this version the portion 6 which comprises the guide means and stationary contact and the movable contact 16 are formed separately. These two elements are mountable on a circuit board having mounting pins on standard centers. Of course, the embodiment shown in FIG. 1 is also suitable for circuit board mounting.

The configuration of the guide means 8, 10 as shown in FIG. 2 is not intended to be limiting. FIG. 2 illustrates four leg portions comprising the zig-zag portion 8 of the guide means and a single leg portion 10 comprising the remainder thereof. Other alternatives include two or three legs instead of 4 on the zig-zag portion 8. The number of legs utilized would determine the length of time that the acceleration force must be sustained in order to drive the movable contact to the base position 12. Also, a third contact could be provided at the uppermost portion of the zig-zag portion 8, thereby providing a single pole-double throw version of the switch.

Figure 4:
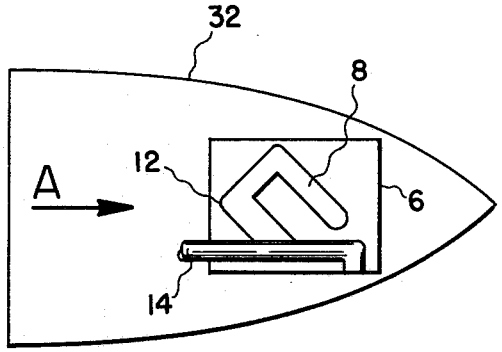
FIG. 4 illustrates the manner in which the switch of the present invention may be incorporated into a projectile so that it will be actuated upon launching of the projectile.

FIG. 4 illustrates the manner in which the switch of the present invention is incorporated into a projectile in order to provide the arming signal therefor. The device is mounted in the projectile in such manner that the base 12 of the guide portion is oriented generally toward the rearmost portion of the projectile in flight. Upon firing of the projectile, and application of acceleration forces as shown by arrow A, the movable contact of the switch will be driven toward the rear of the projectile and portion 12 of the guide means. The biasing means 18 will then be able to move the contact into proximity with the stationary element 14, upon removal of the acceleration force.

Figure 5:
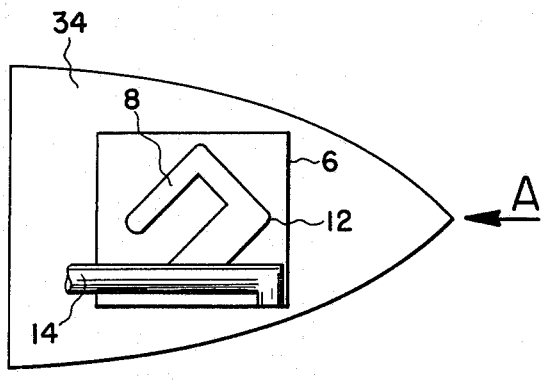
FIG. 5 illustrates the manner in which the switch of the present invention may be incorporated into a projectile in such manner that it will act as a time-delay switch which will act to defer detonation of the explosive upon impact of the projectile with a target.

Thus far, the invention has been described as a safing and arming device for missiles and projectiles. It is also capable of being used as a time-delay switch where the detonation of an explosive must be delayed after the projectile impacts a target in order to achieve target penetration. In this embodiment, as shown in FIG. 5, the switch would be mounted in such fashion that the base 12 of the guide means is oriented toward the front-most portion of the projectile. When the projectile impacts with a target, resulting in acceleration forces as shown by arrow A in FIG. 5, the movable contact will be driven forward toward the base portion 12 of the guide means. After the target is penetrated and the acceleration force subsides, biasing means 18 would close the switch, as previously described.

FIGS. 4 and 5 suggest that the switch of the present invention is designed primarily for projectiles which are fired from a weapon, such as a mortar or artillery. The device is not limited to such uses however. The switch of the present invention is suitable for use with any device which must be actuated upon impact, such as aerial bombs. It is also suitable for use in actuating such equipment as surveillance devices which are dropped from airplanes. Upon impact the switch of the present invention would initiate functioning of such a surveillance device.

While the invention has been described with reference to the accompanying drawings, we do not wish to be limited to the details shown therein as obvious modifications may be made by one of ordinary skill in the art.

We claim:

1. A switch device comprising a first contact means comprising essentially an elastic resilient electrically conductive element biased in a sole direction, a second contact means, guide means for directing said first contact means along a defined path, said defined path comprising at least three distinct portions, wherein successive portions of said path are deviated in direction with respect to one another and each portion of said path forms an acute angle with respect to a line parallel to said sole direction, wherein said first contact means will traverse said defined path through at least two portions thereof in a direction generally opposite said sole direction upon application of an acceleration force in said sole direction and will traverse the remainder of said portions in a direction generally along said sole direction upon release of said acceleration force.

2. A device as in claim 1, wherein said first contact means comprises a resilient spring member biased in a sole direction.

3. A device as in claim 1, wherein said first contact is biased into a first position in said path, said path extending through at least two of said portions thereof from said first position to a second position in a direction generally opposite said sole direction, said path further extending from said second position to a third position in a direction generally along said sole direction, wherein said first contact means contacts said second contact means when said first contact means is at said third position.

4. A device as in claim 3, wherein said path between said first and second positions has a generally zig-zag configuration.

5. A device as in claim 2, further comprising means to vary the effective mass of said first contact means, whereby acceleration force necessary to actuate said device may be varied.

6. A device as in claim 5, wherein said resilient spring member is a cantilevered spring, and said means to vary the effective mass of said first contact means comprises weight means selectively positioned along said spring.

7. A device as in claim 3 in combination with a projectile, said path from said first position to said second position extending generally toward the rear-most portion of the projectile, whereby said device reacts to acceleration forces upon launching of said projectile.

8. A device as in claim 3 in combination with a projectile, said path from said first position to said second position extending generally toward the front-most portion of the projectile whereby said device reacts to forces upon impact of said projectile with an object.

9. A switching device as in claim 3 or 8, wherein said first and second contact means remain out of contact with one another until said acceleration force has acted upon said device for a sufficient length of time to move said first contact means to said second position, and until said first contact means has moved to said third position, whereby said device constitutes a time-delay switch.

* * * * *